US005104555A

United States Patent [19]

Foster et al.

[11] Patent Number: 5,104,555

[45] Date of Patent: Apr. 14, 1992

[54] FABRIC TREATMENT COMPOSITION WITH SOFTENING PROPERTIES

[75] Inventors: Francis G. Foster; Graham A. Turner, both of Merseyside, England

[73] Assignee: Lever Brothers Company, Division of Conopco, Inc., New York, N.Y.

[21] Appl. No.: 592,424

[22] Filed: Oct. 3, 1990

[30] Foreign Application Priority Data

Oct. 6, 1989 [GB] United Kingdom ..... 8922595

[51] Int. Cl.[5] ..... D06M 10/08; C11D 17/00

[52] U.S. Cl. ..... 252/8.6; 252/8.75; 252/8.8; 252/8.9; 252/174.15

[58] Field of Search ..... 252/8.6–8.9, 252/174.15

[56] References Cited

U.S. PATENT DOCUMENTS

| | | | |
|---|---|---|---|
| 4,540,499 | 12/1985 | Sakatani et al. . | |
| 4,585,563 | 4/1986 | Busch et al. | 252/8.8 |
| 4,639,321 | 1/1987 | Barrat et al. | 252/8.8 |
| 4,767,548 | 8/1988 | Kasprzak et al. | 252/8.8 |
| 4,954,270 | 9/1990 | Butterworth | 252/8.8 |

FOREIGN PATENT DOCUMENTS

| | | |
|---|---|---|
| 0150867 | 4/1984 | European Pat. Off. . |
| 213730 | 3/1987 | European Pat. Off. . |
| 276997 | 8/1988 | European Pat. Off. . |
| 276999 | 8/1988 | European Pat. Off. . |
| 320296 | 6/1989 | European Pat. Off. . |
| 1549180 | 3/1986 | United Kingdom . |

OTHER PUBLICATIONS

Co-pending application—Foster et al. Ser. No. 231,621.

*Primary Examiner*—A. Lionel Clingman
*Assistant Examiner*—William S. Parks
*Attorney, Agent, or Firm*—A. Kate Huffman

[57] ABSTRACT

A fabric treatment composition comprising (i) a polysiloxane textile treatment agent;

(ii) a water-soluble nonionic cellulose ether having an HLB between 3.0 and 4.3, and a gel point of less than 58° C. provided that the cellulose ether contains substantially no hydroxyalkyl groups containing 3 or more carbon atoms.

10 Claims, No Drawings

FABRIC TREATMENT COMPOSITION WITH SOFTENING PROPERTIES

BACKGROUND

This invention relates to a composition for treating fabrics, in particular to such compositions which are capable of softening fabrics for example natural fibre wash load articles without causing redeposition problems on any synthetic fibre fabrics in the load or fabrics in the rinse step of a washing process. In particular the invention is directed to alkaline compositions capable of achieving an optimum balance of softening and detergency across a mixed fibre wash load, and to neutral to acid compositions capable of providing unique softening to fabrics in the rinse or drying stage.

It is desirable to overcome the possible harshening of fabrics which may result from repeated washing by treating the fabrics with a fabric softening agent either during the fabric washing step or in a subsequent fabric rinsing or drying operation. Amongst the materials proposed as fabric softening agents are quaternary ammonium compounds, imidazolinium derivatives, fatty amines, fatty amine oxides, soaps, clays and mixtures thereof. Harshening of fabrics is a particular problem when the fabric is formed of or contains natural fibres such as cotton and wool.

A problem associated with the deposition of organic fabric softening agents on fabrics during the wash is that to achieve a desirable degree of softening effect on fabrics, an increase in the deposition of fatty and particulate soil occurs on synthetic fabrics, leading to unsightly discolouration.

Products designed for cleaning fabrics often contain in addition to a detergent active material to remove soil from the fabric, an anti-redeposition material to reduce the redeposition of the removed soil from the wash liquor back onto the fabrics. Sodium carboxy methyl cellulose (SCMC) is one material used for this purpose. It reduces redeposition of clay and soot (or carbon) particulate soils onto hydrophilic fabrics such as cotton but not on hydrophobic fabrics.

For hydrophobic fabrics, such as polyester and acrylic fabrics, problems of redeposition are particularly extreme because the redeposition problem is one of organic fatty soil together with particulate, inorganic, soil.

The problem of redeposition on hydrophobic fabrics can be alleviated by incorporation of certain nonionic cellulose ether polymers, as described in South African Patent Specification No. 71/5149 (Unilever).

It is proposed in U.S. Pat. No. 3,920,561 (DESMARAIS assigned to THE PROCTER AND GAMBLE COMPANY) to treat fabrics with a composition comprising a fabric softener and a highly substituted methyl cellulose derivative, such as a methyl cellulose containing from 2.14 to 2.62 methyl groups per anhydroglucose ring, in order to impart superior soil release benefits, especially to polyester fabrics while simultaneously imparting fabric softness in the rinse. These specified cellulose ether derivatives however do not increase the deposition of organic fabric softening agents on natural fibre fabrics in the wash step. It has been disclosed in EP 276 999 (Unilever) to condition fabrics in the rinse step of a fabric laundering process with a non-cationic fabric softening agent and a nonionic cellulose ether polymer.

It is proposed in European Patent Application No. 150 867 (Procter and Gamble Company) to add polysiloxanes to granular built detergent compositions to impart through the wash softening benefits to fabrics treated therewith. GB 1 549 180 (Procter and Gamble) discloses the use of predominantly linear siloxanes in rinse conditioner products.

In European Patent Application No. 213730 (Unilever PLC) there is disclosed a selected class of nonionic cellulose ethers which, in addition to controlling redeposition on synthetic fibres are capable of enhancing fabric softening in the wash step on natural fibre fabrics. The combination of a fabric softening agent and the selected cellulose ether is also disclosed.

We have now surprisingly found that the combination of this selected class of cellulose ether and a polysiloxane fabric softener gives enhanced softening benefits to fabrics treated therewith.

Thus, according to the invention there is provided a fabric treatment composition comprising:

(i) a polysiloxane textile treatment agent;

(ii) a water-soluble nonionic cellulose ether having an HLB of between 3.0 and 4.3, preferably between 3.1 and 3.8, more preferably 3.3 and 3.8, and a gel point of less than 58° C., preferably between 30° C. and 56° C., provided that the cellulose ether contains substantially no hydroxyalkyl groups containing 3 or more carbon atoms.

The cellulose ethers useful in the present invention are nonionic cellulose ethers, of which some or all of the three hydroxyl sites per anhydroglucose ring of the polymer have been substituted with a nonionic substituent group.

Preferably the substituent groups are selected from the $C_2$–$C_3$ alkyl and $C_2$–$C_3$ mono- or polyhydric hydroxy alkyl groups, or combinations thereof. Especially the use of alkyl hydroxyalkyl cellulose ethers is preferred. Most preferred is the use of ethyl hydroxyethyl substituted cellulose ethers. The choice and percentage of substituent groups has a direct influence on the HLB value of the cellulose ether.

The useful substituted cellulose ethers are defined in part by their HLB. HLB is a well known measure of the hydrophilic-lyophilic balance of a material and can be calculated from its molecular structure.

A suitable estimation method for emulsifiers is described by J. T. Davies, 2nd Int. Congress of Surface Activity 1957, I pp. 426–439. This method has been adopted to derive a relative HLB ranking for cellulose ethers by summation of Davies's HLB assignments for substituent groups at the three available hydroxyl sites on the anhydroglucose ring of the polymer. The HLB assignments for substituent groups include the following:

| | |
|---|---|
| Residual hydroxyl | 1.9 |
| Methyl | 0.825 |
| Ethyl | 0.350 |
| Hydroxy ethyl | 1.63 |

The cellulose ether derivatives useful herein are polymers which are water-soluble at room temperature. The gel point of polymers can be measured in a number of ways. In the present context the gel point is measured on a polymer solution prepared by dispersion at 60°/70° C. and cooling to 20°–25° C. at 10 g/l concentration in deionised water. 50 ml of this solution placed in a beaker is heated, with stirring, at a heating rate of approximately 5° C./minute. The temperature at which the solution clouds is the gel point of the cellulose ether being tested and is measured using a Sybron/Brinkmann colorimeter at 80% transmission/450 nm.

Provided that the HLB and gel point of the polymer fall within the required ranges, the degree of substitution (DS) of the anhydroglucose ring may be any value up to the theoretical maximum value of 3, but is preferably from about 1.7–2.9, there being a maximum of 3 hydroxyl groups on each anhydroglucose unit in cellulose. The expression 'molar substitution' (MS) is sometimes also used in connection with these polymers and refers the number of hydroxyalkyl substituents per anhydroglucose ring and may be more than 3 when the substituents themselves carry further substituents.

The most highly preferred polymers have an average number of anhydroglucose units in the cellulose polymer, or weight average degree of polymerisation, from about 50 to about 1,200. For certain product forms, e.g. liquids, it may be desirable to include polymers of relatively low degree of polymerisation to obtain a satisfactory product viscosity.

A number of cellulose ether derivatives suitable for use in the present invention are commercially available, as follows:

| Trade Name | Gel Point °C. | HLB (Davies) | alkyl/ hydroxyalkyl |
|---|---|---|---|
| BERMOCOLL CST035 (ex Berol Nobel) | 35 | 3.40 | 1.4 ethyl 0.5 hydroxyethyl |
| DVT 88004 (ex Berol Nobel) | 37 | 3.11 | 1.5 ethyl 1.0 hydroxyethyl |
| TYLOSE MHB 1000 (ex Hoechst) | 54 | 3.52 | 2.0 methyl 0.1 hydroxyethyl |

A number of other cellulose ether derivatives are known from the prior art, but have been found to be unsuitable for use in the present invention. Thus, British Specification No. GB 2 038 353B (COLGATE-PALMOLIVE) discloses TYLOSE MH 300 (ex Hoechst) which has a gel point of 58° C. and METHOCEL XD 8861 (ex Dow Chemical Company, now coded METHOCEL HB12M) which contains about 0.1 hydroxybutyl substituents per anhydroglucose ring, while Japanese Patent Specification No. 59-6293 (LION KK) discloses KLUCEL H (ex Hercules Chemical Corp) which has an HLB of about 4.4, METHOCEL K4M (ex Dow Chemical Company) which has a gel point of about 69° C., and NATROSOL 250H (ex Hercules Chemical Corp) which has an HLB of about 6.9.

The amount of cellulose ether to be employed in compositions according to the invention is preferably from 0.05 to 5%, more preferably from 0.5 to 3% by weight of the composition.

Preferred cellulose ethers for use in compositions of the present invention have an HLB of between 3.3 and 3.8 and a gel point of between 30° and 56° C. Especially preferred is the use of Bermocoll CST035.

The polysiloxane fabric softener suitable for use in compositions according to the invention may be any silicone compound suitable for the treatment of fabrics. Suitable materials may be predominantly linear, branched or cross-linked materials as disclosed in for example Chemistry and Technology of the Silicones, W. Noll, Academic Press, 1968, eventually substituted with groups such as halides, amine groups, alkyl groups etc.

Preferred polydiorganosiloxanes are poly $C_{1-4}$ alkyl-/aryl/alkoxy siloxanes such as polydimethylsiloxanes, polyphenylmethyl-siloxanes and the dimethylsiloxane glycol copolymers, preferably the amino substituted species.

The polydiorganosiloxane used in the present invention may have any viscosity which allows the processing of the material in the fabric treatment composition. For granular fabric treatment compositions it may be advantageous to dry-mix the silicone component with the other ingredients in the presence of small amounts of water, under these circumstances it may be advantageous to use silicones of relatively low viscosity that is in the range from 20 to 100,000, preferably from 200 to 50,000 centistokes at 25° C., as measured on the pure material using a Brookfield viscometer. For liquid fabric treatment compositions it may be advantageous to incorporate the siloxane component in emulsified form, then the viscosity of the siloxane component is less critical as emulsified siloxanes of very low viscosity to very high viscosity are commercially available. For all purposes it is preferred to use siloxane materials which are water-insoluble.

Suitable polydialkyl siloxane materials, comprising amino substituent groups can for instance be represented with the aid of the following formula.

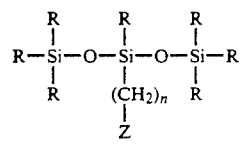

wherein

R = $C_{1-4}$ alkyl; n is zero or an integer 1–6;

Z is

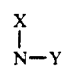

where X and Y are selected independently from —H; —$C_{1-30}$-alkyl; —$C_6$-aryl; —$C_{5-6}$-clycloalkyl; —$C_{16}$—$NH_2$; —CO—R; with the proviso that the nitrogen can be quaternized such as to represent

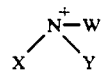

whereby W can be selected from X and Y;

or Z is

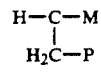

where P and M are —COOH; —CO—$NR_2$; or —CO—OR′ and wherein R′ is H or $C_{1-2}$ - alkyl; with the proviso that the degree of substitution, i.e. the molar proportion of non-terminal silicon carrying a substituent other than a $C_{1-4}$ alkyl group to total non-terminal silicon is in the range from 0.01 to 0.7; preferably from 0.02 to 0.3.

In the preferred siloxane component herein, n is 3 or 4, X and Y are; selected independently from hydrogen, $C_{1-4}$ alkyl, $C_{5-6}$ cycloalkyl and $C_2$—$NH_2$.

Preferred organofunctional polydimethyl siloxanes include aminofunctional siloxanes, such as; $\alpha,\omega$ dihydroxy polydimethyl siloxane with pendant amine groups. Other preferred siloxane materials are highly viscous or cross-linked materials such as HV 490 (Dow Corning), TP 226 (Union Carbide).

The level of the polysiloxane in the compositions of the invention is ideally from 0.1% to 3% by weight, preferably 0.5% to 2% by weight.

Preferably the ratio of polysiloxane to cellulose ether is in the range of 0.05:1 to 3:1 parts by weight.

The compositions according to the invention optionally additionally contain one or more fabric softening materials or detergent active materials, selected from soaps, non-soap anionic, nonionic, zwitterionic and amphoteric synthetic detergent active materials, cationic, nonionic, zwitterionic and amphoteric fabric softening materials. Nonionic materials are especially useful in the context of the present invention. Many suitable detergent compounds are commercially available and are fully described in the literature, for example in "Surface Active Agents and Detergents", Volumes I and II, by Schwartz, Perry and Berch.

Anionic non-soap detergent active materials are usually water-soluble alkali metal salts of organic mono sulphates and mono sulphonates (as distinguished e.g. from the disulphonates mentioned as organic precipitant builders above) having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acids and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene mono sulphonates and sodium ($C_{16}$–$C_{18}$) alkyl mono sulphates.

Suitable nonionic compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally up to 25 EO, i.e. up to 25 units of ethylene oxide per molecule, the condensation products of aliphatic ($C_8$–$C_{18}$) primary or secondary linear or branched alcohols with ethylene oxide, generally up to 40 EO, and products made by condensation of ethylene oxide with the reaction products of propylene oxide and ethylenediamine. Other so-called nonionic detergent compounds include alkyl polyglycosides, long tertiary amine oxides, long chain tertiary phosphine oxides and dialkyl sulphoxides.

Mixtures of anionic and nonionic compounds may be used in the detergent compositions, particularly to provide controlled low sudsing properties. This is beneficial for compositions intended for use in suds-intolerant automatic washing machines.

Amounts of amphoteric or zwitterionic detergent compounds can also be used in the compositions of the invention but this is not normally desired due to their relatively high cost. If any amphoteric or zwitterionic detergent compounds are used it is generally in small amounts.

The term "soap", includes not only the usual alkali metal and alkaline earth metal salts of fatty acids, but also the organic salts which can be formed by complexing fatty acids with organic nitrogen-containing materials such as amines and derivatives thereof. Usually, the soap comprises salts of higher fatty acids preferably containing from 10 to 20 carbon atoms in the molecule, or mixtures thereof. Examples of suitable soaps include sodium stearate, sodium palmitate, sodium salts of tallow, coconut oil and palm oil fatty acids and complexes between stearic and/or palmitic fatty acids and/or tallow and/or coconut oil and/or palm oil fatty acids with water-soluble alkanolamines such as ethanolamine, di- or tri- ethanolamine, N-methylethanol-amine, N-ethylethanolamine, 2-methylethanolamine and 2,2-dimethyl ethanolamine and N-containing ring compounds such as morpholine, 2'-pyrrolidone and their methyl derivatives.

Mixtures of soaps can also be employed, such as the sodium and potassium salts of the mixed fatty acids derived from coconut oil and tallow, that is sodium and potassium tallow and coconut soap.

Particularly preferred are mixtures of oleate and coconut soaps in a weight ratio of between about 3:1 and 1:1.

It has been found that the presence of soap contributes to a surprising improvement in softening when polysiloxane and cellulose ether are present.

Suitable fabric softening compounds may for instance be selected from soaps (as mentioned hereabove), cationic fabric softening materials, nonionic fabric softening materials. Suitable materials include substantially water-insoluble quaternary ammonium compounds such as for instance disclosed in EP 89200545.5 and EP 239 910, amine materials and amphoteric fabric conditioning materials as disclosed in EP 89200545.5.

Soap is especially preferred as the fabric softening material.

The effective amount of the detergent active or fabric softening compound or compounds used in the composition of the present invention is generally in the range of up to 50%, preferably up to 40% by weight, most preferably not more than 30% by weight of the composition. Preferably the level is above 1%, more preferred more than 2%.

Detergent compositions of the invention may include detergency builder to improve the efficiency of the detergent active, in particular to remove calcium hardness ions from the water and to provide alkalinity. The builder material may be selected from inorganic precipitating builders materials (such as alkali metal carbonates, bicarbonates, borates, orthophosphates and silicates), sequestering builder materials (such as alkali metal pyrophosphates, polyphosphates, amino polyacetates, phytates, polyphosphonates, aminopolymethylene phosphonates and polycarboxylates), ion-exchange builder materials (such as zeolites and amorphous alumino-silicates), organic precipitating builder materials (such as those having the formula (I):

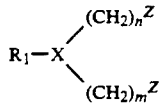

wherein: $R_1$ is is $C_{10}$–$C_{24}$ alkyl or alkenyl, or an arylalkyl or alkylaryl group of equivalent chain length; X is CH, CR, N or CON; $R_2$ is $C_1$–$C_3$ alkyl; 2 is COOY or $SO_3Y$; Y is hydrogen or a solubilising cation, preferably alkali metal and especially sodium; and n and m, which may be the same or different, are O or integers from 1 to 4, or mixtures of any one or more of these materials. Preferred examples of builder materials include sodium tripolyphosphate, mixtures thereof with sodium orthophosphate, sodium carbonate, mixtures thereof with calcite as a seed crystal, sodium citrate, zeolite and the sodium salt of nitrilo- triacetic acid.

The level of such builder material in the compositions of the invention may be up to 80% by weight, preferably from 20% to 70% by weight and most preferably from 30% to 60% by weight.

Detergent compositions according to the invention preferably are alkaline, in that they yield a pH of more than 8.0 when added to water at a concentration of 1% by weight at 25° C.

Apart from the components already mentioned, a detergent composition of the invention can contain any of the conventional additives in the amounts in which such additives are normally employed in fabric washing detergent compositions. Examples of these additives include additional fabric softening agents. We have found particularly beneficial effects when the fabric softening agent is a mixture of organic precipitating builder and either a cationic fabric softening agent or a fatty amine. Other optional additives include the lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as tricloroisocyanuric acid, inorganic salts such as sodium sulphate, and, usually present in very minor amounts, fluorescent agents, perfumes including deodorant perfumes, enzymes such as cellulases, proteases and amylases, germicides and colourants.

The compositions may be in any convenient form such as bars, powders, pastes or liquids which may be aqueous or non-aqueous and structured or unstructured.

The detergent compositions may be prepared in any way appropriate to their physical form such as by dry-mixing the components, co-agglomerating them or dispersing them in a liquid carrier. However, a preferred physical form is a granule incorporating a detergency builder material and this is most conveniently manufactured by spray-drying at least part of the composition. The cellulose ether may be incorporated either by dry mixing (optionally with other ingredients in a post-dosed adjunct) or by being included with other ingredients in a slurry and spray-drying. The fabric softening agent may be incorporated as such or it may be incorporated in the form of particles.

Compositions of the present invention which are specifically suitable for use in the rinse or drying stage of the fabric laundering process, preferably comprise:

(i) 0.1 to 5% by weight of the cellulose ether as defined above.

(ii) 0.1 to 5% by weight of the polysiloxane.

(iii) from 1 to 70% of a fabric softening material.

Preferably the fabric softening material comprises soap. For environmental reasons it may be advantageous to minimize the amount of quaternary ammonium compounds in the composition. The present invention surprisingly allows the formulation of a fabric treatment compositions which are substantially free from non-biodegradeable materials and/or substantially free from cationic materials such as quaternary ammonium compounds. It has been found that the combined use of silicones, specific cellulose ethers and environmentally friendly softening materials such as soap provides surprisingly good softening to fabrics in the rinse or drying stage. Preferably the level of soap in compositions of the invention is greater than 1%, more preferred greater than 2%, especially preferred greater than 3%. Preferably the level of soap is less than 90%, more preferred less than 50%, especially preferred less than 40%, typically from 3–30% by weight of the composition.

For use in the rinse cycle of the fabric laundry process, compositions of the present invention are preferably liquid and comprise an aqueous base, which may constitute from 5 to 97% by weight of the composition. For use in the drying stage of the fabric laundry process, e.g. for use in a tumble dryer, compositions of the invention are advantageously applied to a carrier material e.g. to a flexible sheet substrate, which is intended for co-mingling with the fabrics. Compositions to be applied to the substrate may be substantially water-free and may for instance be liquified by melting or by solvent dilution.

The pH of fabric softening compositions for use in the rinse is preferably less than 8.0 when added to water of 25° C. at a concentration of 1% by weight of active materials.

The invention will now be illustrated in the following non-limiting examples.

EXAMPLES 1 to 4

Detergent compositions were prepared having the following formulations. The compositions were prepared by dry mixing the stated ingredients.

| Ingredients (parts by weight) | Base A | Base B |
|---|---|---|
| Nonionic detergent[1] | 5 | 5 |
| Anionic detergent[2] | 2 | 2 |
| Tallow soap | 15 | — |
| Sodium tripolyphosphate | 15 | 24 |
| Silicate | 10 | 10 |
| Sulphate | 45 | 55 |
| Polysiloxane and/or | balance | balance |

-continued

| Ingredients (parts by weight) | Base A | Base B |
|---|---|---|
| cellulose ether and water | | |

Notes
[1]Dobanol 45-7EO which is a fatty alcohol ethoxylated with an average of 7 ethylene oxide groups per molecule (ex Shell).
[2]Dobane 113 which is a sodium $C_{11}$-$C_{13}$ linear alkyl benzene sulphonate (ex Shell).

In practice, a number of other ingredients will often be present in such compositions. However, in these examples, such ingredients are replaced by sodium sulphate.

The compositions were added to water at a dosage level of 5 g/l. The wash liquor so prepared was used to wash a fabric load containing terry towelling monitors in a laboratory scale apparatus using 24° FH water, a liquor to cloth ratio of about 20:1, a wash time of 15 minutes at 40° C., a 2 minute flood at 50% dilution followed by two five minute rinses. This procedure was repeated twice. The fabric load was then line-dried. After drying the monitors were assessed for softness by comparison of pairs of monitors leading to preference scores. The more positive the score, the softer the sample.

The identification of the polysiloxane and cellulose ether and the results are set out in the following table. The cellulose ether and/or polysiloxane were used at a level of 3 parts by weight to that of the base.

| Example No. | Base | EHEC[4] | PS[5] | Softening Score |
|---|---|---|---|---|
| 1 | A | — | — | −0.51 |
| 2 | A | 3 | — | +0.51 |
| 3 | A | — | 3 | +0.14 |
| 4 | A | 1.5 | 1.5 | +1.16 |

Notes
[4]DVT 88004 - an ethyl hydroxyethyl cellulose ether with an ethyl substitution of 1.5 and a hydroxyethyl substitution of 1, gel point 37° C. (ex Berol Nobel)
[5]VP1487E - a 'self-crosslinking' w - dihydroxy polydimethyl siloxane with pendant amine in a cationic emulsifier (ex Wacker Chemie, viscosity 40,000 centistrokes).

The softening score difference for 90% confidence limit was 0.54. These results therefore show that a significant softening improvement is obtained by the combination of cellulose ether and polysiloxane.

EXAMPLES 5 to 9

The procedure of Examples 1 to 4 was followed using different combinations of cellulose ether and polysiloxane. In each case the cellulose ether and/or polysiloxane were used at a level of 3 parts by weight to that of the base.

| Example No. | Base | EHEC[6] | PS[5] | PS[7] | Softening Score |
|---|---|---|---|---|---|
| 5 | A | — | — | — | −1.04 |
| 6 | A | 3 | — | — | +0.16 |
| 7 | A | — | — | 3 | −0.62 |
| 8 | A | 1.5 | — | 1.5 | +0.82 |
| 9 | A | 1.5 | 1.5 | — | +0.67 |

Notes
[6]Bermocoll CST 035 - an ethyl hydroxyethyl cellulose ether with an ethyl substitution of 1.4 and a hydroxyethyl substitution of 6.5, gel point 35° C.
[7]VP 1445E a 'self-crosslinking' w - dihydroxy polydimethyl siloxane with pendant amine groups in a nonionic emulsifier (ex Wacker Chemie, viscosity 40,000 centistokes).

The softening score difference for 90% confidence limit was 0.40. These results therefore show the significant softening improvement obtained by the combination of cellulose ether and polysiloxane.

EXAMPLES 10 to 13

The procedure of Examples 1 to 4 was followed using Base B. In each case the cellulose ether and/or polysiloxane were used at a level of 3 parts by weight to that of the base.

| Example No. | Base | EHEC[6] | PS[7] | Softening Score |
|---|---|---|---|---|
| 10 | B | — | — | −0.51 |
| 11 | B | 3 | — | −0.79 |
| 12 | B | — | 3 | +0.40 |
| 13 | B | 1.5 | 1.5 | +0.89 |

The softening score difference for 90% confidence limit was 0.40. These results therefore show the significant softening improvement obtained by the combination of cellulose ether and polysiloxane in the absence of soap.

EXAMPLES 14–17

Fabric softening compositions were prepared having the following formulations, by dispersing the cellulose ether in water of 70° C., and mixing this into a hot premix of soap and the silicone.

EXAMPLE

| INGREDIENTS (% wt) | 14 | 15 | 16 | 17 |
|---|---|---|---|---|
| soap*) | 20.0 | 20.0 | 20.0 | 20.0 |
| silicone**) | — | 0.15 | — | 0.15 |
| cellulose ether***) | — | — | 0.5 | 0.5 |

*)a mixture of oleate and coconut soaps in a weight ratio of 3:1 and 1:1.
**)HV490 (Dow Corning)
***)Bermocoll CST 035

The composition had a pH of less than 8 when diluted to an active level of 1% in water of 25° C.

The compositions were tested as follows: 2 ml of the composition was added to a tergometer containing 1 liter of 26° FH water at room temperature. 3 20×20 cm pieces of desized terry towelling were added to the termometer and agitated for 5 minutes. The towelling cloths were then line dried and their softness was assessed by a process of paired comparison with a 90% confidence level of 0.51.

The following softness scores were obtained:

| EXAMPLE | SCORE |
|---|---|
| 14 | 22 + 0.07 |
| 15 | 22 0 |
| 16 | 55 + .095 |
| 17 | 80 + 1.53 |

The results clearly indicate that addition of silicone to a fabric softener containing soap does not enhance the softening (comparative examples 14 and 15), if however silicones are added to a combination of soap and cellulose ethers a surprising increase in softening performance can be observed (comparative example 16, example 17 according to the invention).

We claim:

1. A fabric treatment composition comprising (i) 0.1 to 5% by weight of a polydiorganosiloxane textile treatment agent which is unsubstituted or amino-substituted, the polydiorganosiloxane having organo-groups independently selected from aryl, alkoxy and $C_{1-4}$ alkyl; and (ii) 0.05 to 5% by weight of a water-soluble nonionic cellulose ether having a hydrophilic to lipophilic balance (HLB) of between 3.0 and 4.3, and a gel point of less than 58° C. provided that the cellulose ether contains substantially no hydroxyalkyl groups containing 3 or more carbon atoms.

2. A composition as claimed in claim 1 wherein the nonionic cellulose ether has an HLB between 3.1 and 3.8.

3. A composition as claimed in claim 1 wherein the nonionic cellulose ether has an HLB between 3.3 and 3.8.

4. A composition as claimed in claim 1 wherein the cellulose ether has a gel point between 30° C. and 56° C.

5. A composition as claimed in claim 1 wherein the composition comprises from 0.1% to 3% by weight of polysiloxane.

6. A composition as claimed in claim 1 wherein the composition comprises from 5% to 3% by weight of nonionic cellulose ether.

7. A composition as claimed in claim 1 wherein the ratio of polysiloxane to cellulose ether is in the range of 0.05:1 to 3:1 parts by weight.

8. A composition as claimed in claim 1 wherein the composition further comprises a detergent active material.

9. A composition as claimed in claim 1 wherein the composition further comprises soap.

10. A fabric treatment composition for use in the rinse or drying stage of a fabric laundering process comprising:

(i) 0.1 to 5% by weight of a water soluble nonionic cellulose ether having an HLB between 3.0 and 4.3, and a gel point of less tan 58° C. provided that the cellulose ether contains substantially no hydroxyalkyl groups containing 3 or more carbon atoms;

(ii) 0.1 to 5% by weight of a polydiorganosiloxane textile treatment agent which is unsubstituted or amino-substituted, the polydiorganosiloxane having organo-groups independently selected from aryl, alkoxy and $C_{1-4}$ alkyl; and (iii) 1 to 70% by weight of a fabric softening material.

* * * * *